US008299985B2

(12) United States Patent
Shin et al.

(10) Patent No.: US 8,299,985 B2
(45) Date of Patent: Oct. 30, 2012

(54) METHOD OF POWER CONSERVATION FOR ORGANIC LIGHT-EMITTING DISPLAY ACCORDING TO LIGHT EMITTING AREA RATIO

(75) Inventors: Seung Rok Shin, Suwon-si (KR); Hyun Ha Hwang, Gangnam-gu (KR)

(73) Assignee: LG Display Co., Ltd., Seoul (KR)

( * ) Notice: Subject to any disclaimer, the term of this patent is extended or adjusted under 35 U.S.C. 154(b) by 773 days.

(21) Appl. No.: 11/917,849

(22) PCT Filed: Jun. 19, 2006

(86) PCT No.: PCT/KR2006/002334

§ 371 (c)(1),
(2), (4) Date: Dec. 17, 2007

(87) PCT Pub. No.: WO2006/135219

PCT Pub. Date: Dec. 21, 2006

(65) Prior Publication Data

US 2008/0198105 A1 Aug. 21, 2008

(30) Foreign Application Priority Data

Jun. 17, 2005 (KR) ..... 10-2005-0052447

(51) Int. Cl.
*G09G 3/30* (2006.01)

(52) U.S. Cl. ..... 345/77; 345/76; 345/212; 315/169.3

(58) Field of Classification Search ..... 345/76–83, 345/204, 211–214; 315/169.3
See application file for complete search history.

(56) References Cited

U.S. PATENT DOCUMENTS

| | | | | |
|---|---|---|---|---|
| 5,343,215 | A | 8/1994 | Tanaka | |
| 6,326,938 | B1 * | 12/2001 | Ishida et al. | 345/63 |
| 6,618,031 | B1 * | 9/2003 | Bohn et al. | 345/83 |
| 6,987,521 | B2 * | 1/2006 | Mori et al. | 345/690 |
| 7,663,597 | B2 * | 2/2010 | Plut | 345/102 |
| 7,719,495 | B2 * | 5/2010 | Lee et al. | 345/77 |
| 7,782,279 | B2 * | 8/2010 | Lee et al. | 345/82 |
| 7,800,559 | B2 * | 9/2010 | Weitbruch et al. | 345/77 |
| 2003/0085905 | A1 * | 5/2003 | Mori et al. | 345/589 |
| 2003/0218583 | A1 * | 11/2003 | Hasagawa | 345/76 |
| 2004/0233146 | A1 * | 11/2004 | Nguyen | 345/82 |
| 2005/0052446 | A1 * | 3/2005 | Plut | 345/211 |

(Continued)

FOREIGN PATENT DOCUMENTS

JP 1997-305146 A 11/1997

(Continued)

*Primary Examiner* — Amare Mengistu
*Assistant Examiner* — Gene W Lee
(74) *Attorney, Agent, or Firm* — Birch, Stewart, Kolasch & Birch, LLP

(57) ABSTRACT

Provided is an organic light-emitting display device. The organic light-emitting display device includes a light-emitting unit having a plurality of OLEDs to emit light, a light-emitting level setting unit setting a light-emitting level depending on a light-emitting area and/or change in a light-emitting degree of the light-emitting unit, a look-up table in which data for the light-emitting degree of the light-emitting unit that corresponds to each light-emitting area for each light-emitting level is set and stored, a light-emitting control unit controlling the light-emitting area of the light-emitting unit and/or the light-emitting degree depending on a light-emitting level with reference to the data set on the look-up table.

19 Claims, 5 Drawing Sheets

U.S. PATENT DOCUMENTS

| | | | | |
|---|---|---|---|---|
| 2005/0270283 | A1* | 12/2005 | Plut | 345/211 |
| 2006/0001613 | A1* | 1/2006 | Routley et al. | 345/76 |
| 2006/0001658 | A1* | 1/2006 | Plut | 345/211 |
| 2006/0001659 | A1* | 1/2006 | Plut | 345/211 |
| 2006/0001660 | A1* | 1/2006 | Plut | 345/211 |
| 2006/0022915 | A1* | 2/2006 | Weitbruch et al. | 345/77 |
| 2006/0061563 | A1* | 3/2006 | Fleck | 345/211 |
| 2006/0087502 | A1* | 4/2006 | Karidis et al. | 345/211 |
| 2006/0119543 | A1* | 6/2006 | Hu | 345/45 |
| 2006/0250385 | A1* | 11/2006 | Plut | 345/211 |
| 2007/0146252 | A1* | 6/2007 | Miller et al. | 345/77 |
| 2008/0055196 | A1* | 3/2008 | Izumida | 345/46 |
| 2008/0088548 | A1* | 4/2008 | Lee et al. | 345/77 |
| 2009/0058765 | A1* | 3/2009 | Hashimoto et al. | 345/60 |
| 2010/0220090 | A1* | 9/2010 | Plut | 345/211 |

FOREIGN PATENT DOCUMENTS

| | | | |
|---|---|---|---|
| JP | 2000-221944 | A | 8/2000 |
| KR | 10-2003-0073581 | A | 9/2003 |

* cited by examiner

[Fig. 1]
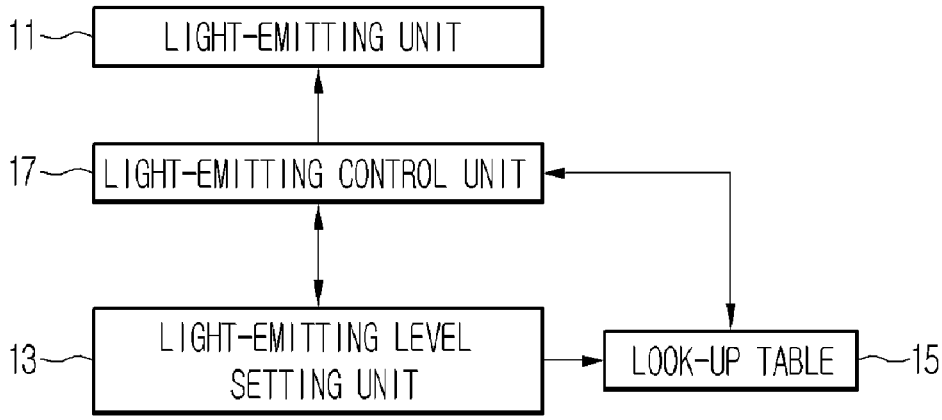
[Fig. 2]
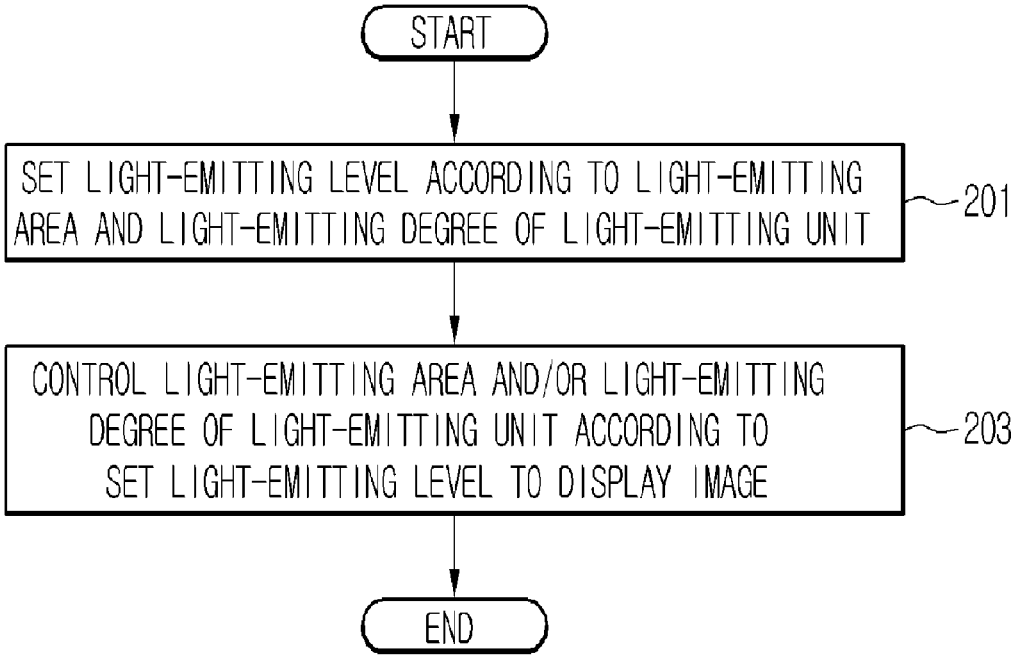

[Fig. 3]
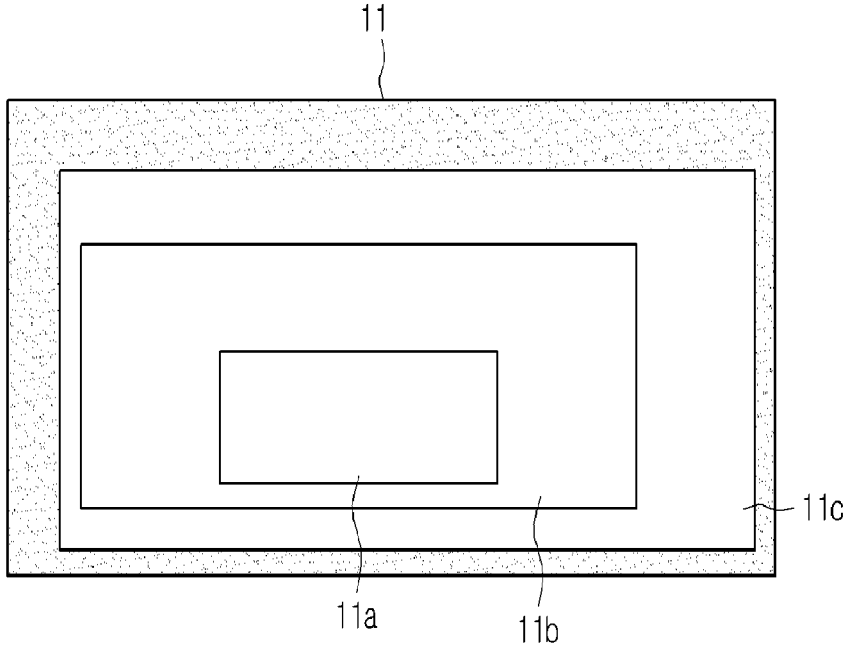
[Fig. 4]
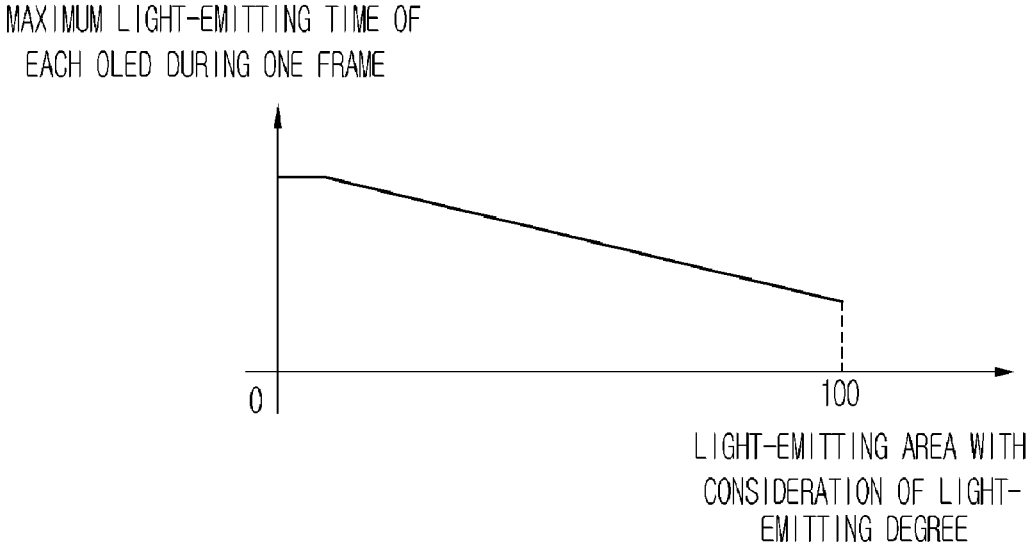

[Fig. 5]

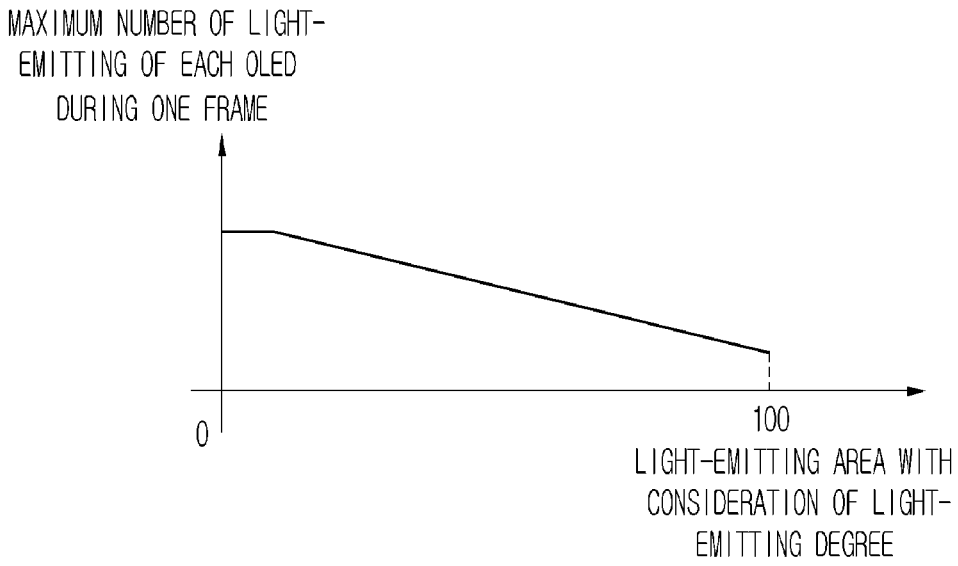

[Fig. 6]

| Level | Description |
|---|---|
| 0 | 20% White Window Pattern or Equal power consumption pattern |
| 1 | 20.6% White Window Pattern or Equal power consumption pattern |
| 2 | 21.3% White Window Pattern or Equal power consumption pattern |
| ⋮ | ⋮ |
| 124 | 98.1% White Window Pattern or Equal power consumption pattern |
| 125 | 98.8% White Window Pattern or Equal power consumption pattern |
| 126 | 99.4% White Window Pattern or Equal power consumption pattern |
| 127 | 100% White Window Pattern |

[Fig. 7]
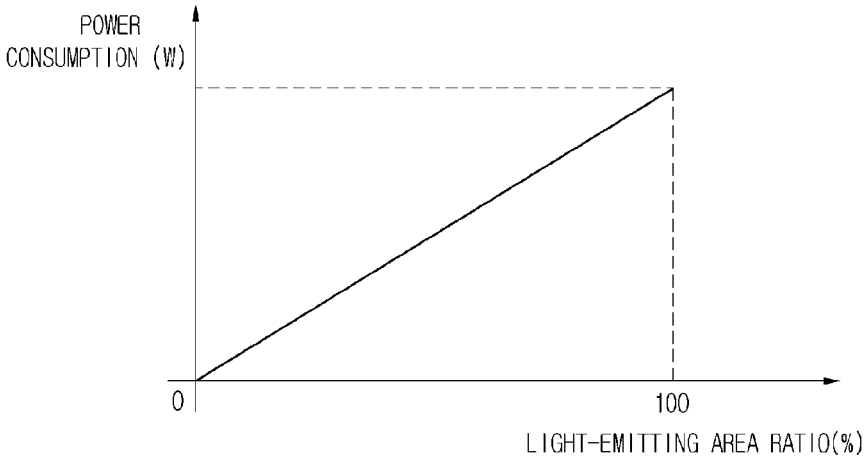
[Fig. 8]
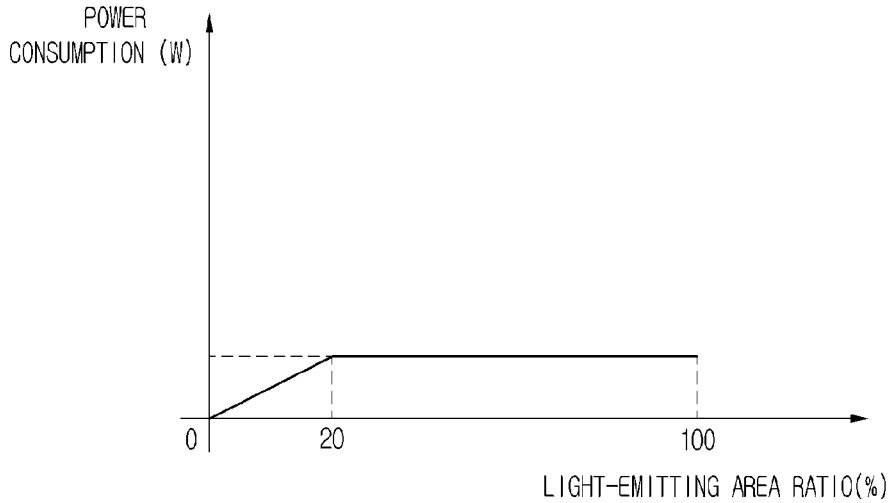
[Fig. 9]
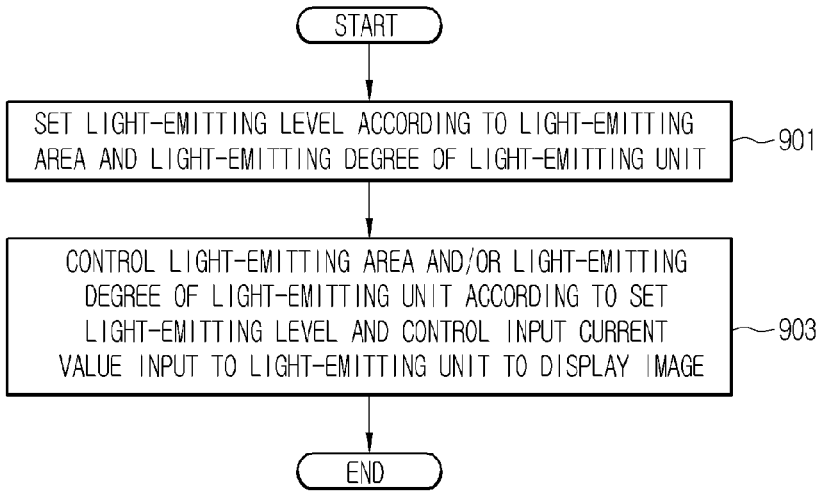

[Fig. 10]
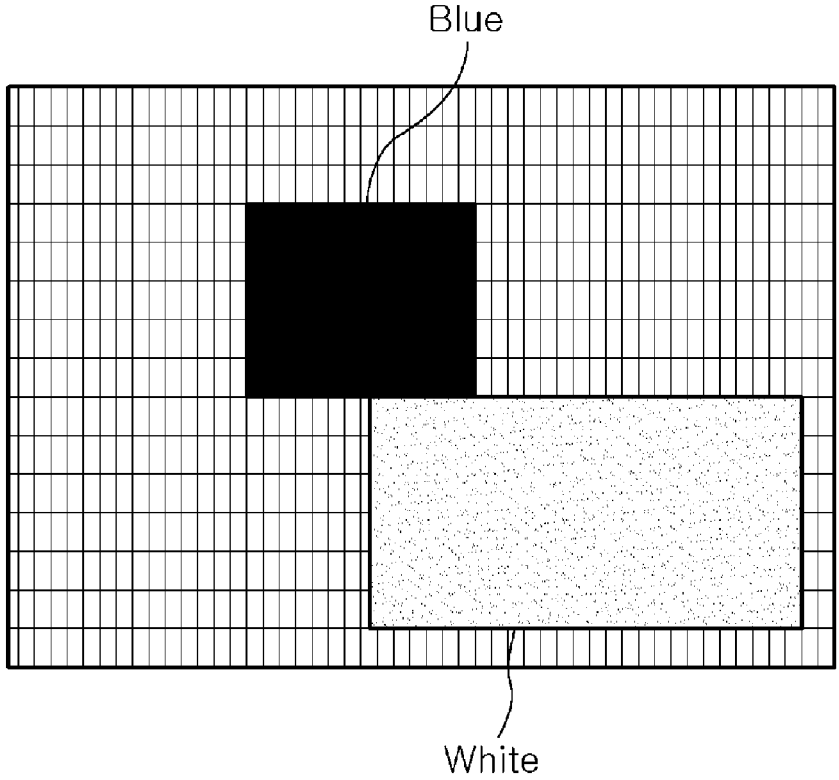
[Fig. 11]
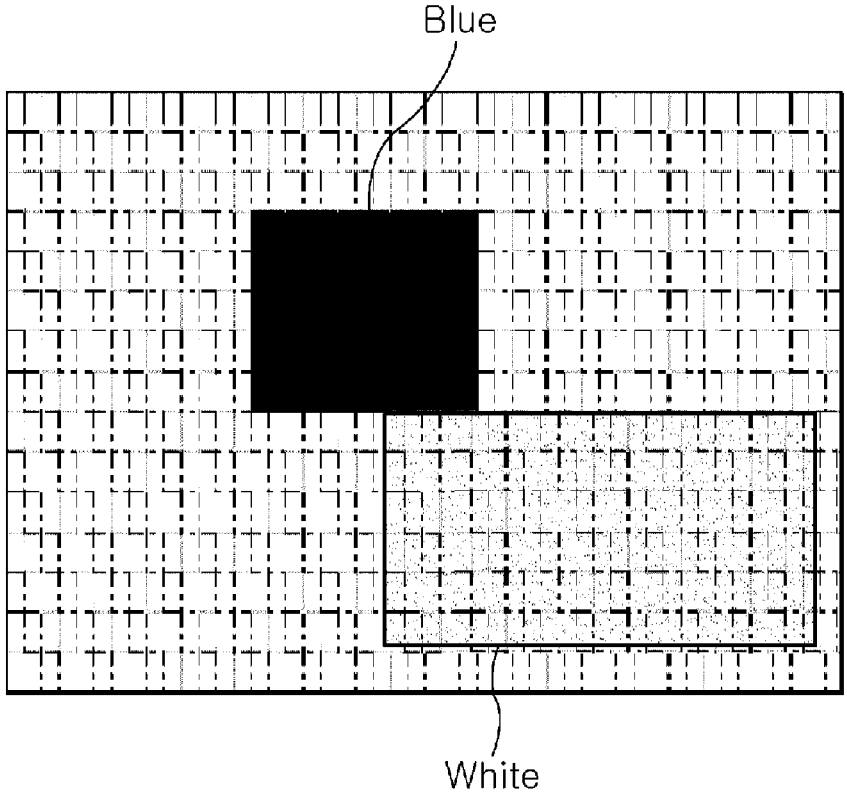

METHOD OF POWER CONSERVATION FOR ORGANIC LIGHT-EMITTING DISPLAY ACCORDING TO LIGHT EMITTING AREA RATIO

CROSS-REFERENCE TO RELATED APPLICATION

This application is the U.S. national stage application of International Patent Application No. PCT/KR2006/002334, filed Jun. 19, 2006, which claims priority to Korean Patent Application No. KR10-2005-0052447, filed Jun. 17, 2005, the disclosure of each of which is hereby incorporated by reference in its entirety.

TECHNICAL FIELD

The present invention relates to an organic light-emitting display device and a driving method thereof.

BACKGROUND ART

Generally, an organic light-emitting display device is a self-luminous display device electrically exciting a phosphorous organic compound to emit light and supplying a current to an N×M matrix consisting of organic light-emitting diodes (OLEDs) to drive the N×M matrix of OLEDs and thus display an image.

A method for driving the OLEDs includes a passive matrix method and an active matrix method using transistors. In the passive matrix method, an anode and a cathode are perpendicularly formed, and a line is selected to drive an organic light-emitting display device. On the other hand, in the active matrix method, transistors and condensers are provided, and a voltage supplied through the transistors is maintained to drive an organic light-emitting display device.

However, when the organic light-emitting display device is used for a mobile communication terminal or a large-scale image display device, there is a serious problem that the organic light-emitting display device consumes much power. Therefore, a research for reducing power consumption of an organic light-emitting display device is in progress in various ways.

DISCLOSURE OF INVENTION

Technical Problem

The present invention is to provide an organic light-emitting display device and a driving method thereof, capable of managing power consumption below a set value regardless of a light emitting area and a light emitting degree of a light-emitting unit having organic light-emitting devices.

The present invention is to provide a mobile communication terminal including an organic light-emitting display device, capable of managing power consumption below a set value regardless of a light emitting area and a light emitting degree of a light-emitting unit having organic light-emitting devices.

Technical Solution

The present invention provides an organic light-emitting display device including: a light-emitting unit having a plurality of OLEDs to emit light; a light-emitting level setting unit setting a light-emitting level depending on a light-emitting area and/or a change in a light-emitting degree of the light-emitting unit; a look-up table in which data for the light-emitting degree of the light-emitting unit that corresponds to each light-emitting area for each light-emitting level is set and stored; a light-emitting control unit controlling the light-emitting area and/or the light-emitting degree of the light-emitting unit depending on a light-emitting level with reference to the data set on the look-up table.

The present invention provides a method of driving an organic light-emitting display device, the method including: extracting data from an input frame and setting a light-emitting level according to a light-emitting area and a change in a light-emitting degree of a light-emitting unit having a plurality of OLEDs; and controlling the light-emitting area and/or light-emitting degree of the light-emitting unit according to the set light-emitting level and displaying an image.

The present invention provides a method of driving an organic light-emitting display device, the method including: extracting data from an input frame and setting a light-emitting level according to a light-emitting area and a change in a light-emitting degree of a light-emitting unit having a plurality of OLEDs; and controlling the light-emitting area and/or light-emitting degree of the light-emitting unit according to the set light-emitting level, and controlling an input current value input to the light-emitting unit to display an image.

The present invention provides a mobile communication terminal including: an organic light-emitting display device including a light-emitting unit having a plurality of OLEDs to emit light, a light-emitting level setting unit setting a light-emitting level according to a light-emitting area of the light-emitting unit and/or a change in a light-emitting degree, a look-up table in which data for the light-emitting degree of the light-emitting unit that corresponds to each light-emitting area for each light-emitting level is set and stored according to the light-emitting level set by the light-emitting level setting unit, a light-emitting control unit controlling the light-emitting area of the light-emitting unit and/or the light-emitting degree depending on a light-emitting level with reference to the data set on the look-up table; a communication element performing communication with the outside; and a controller controlling the communication element and image display by the organic light-emitting display device.

Advantageous Effects

According to the present invention, it is possible to manage power consumption below a set value regardless of a light emitting area and a light emitting degree of a light-emitting unit having an organic light-emitting device.

BRIEF DESCRIPTION OF THE DRAWINGS

FIG. 1 is a schematic block diagram of an organic light-emitting display device according to the present invention;

FIG. 2 is a flowchart illustrating a method of driving an organic light-emitting display device according to the present invention;

FIG. 3 is a diagram explaining a change in a light-emitting area of an organic light-emitting display device according to the present invention;

FIG. 4 is a view explaining a light-emitting time of each organic light-emitting device during one frame for a light-emitting area of an organic light-emitting display device in a method of driving an organic light-emitting display device according to the present invention;

FIG. 5 is a view explaining the number of light-emitting of each organic light-emitting device during one frame for a light-emitting area of an organic light-emitting display device in a method of driving an organic light-emitting display device according to the present invention;

FIG. 6 is a view illustrating an example where a light-emitting area and a light-emitting degree within the area of an organic light-emitting display device are defined in a method of driving an organic light-emitting display device according to the present invention;

FIG. 7 is a view illustrating power consumption versus a light-emitting area ratio when an input current value of an organic light-emitting device is constant in a method of driving an organic light-emitting display device according to the present invention;

FIG. 8 is a view illustrating power consumption when an input current value of an organic light-emitting device is controlled according to a light-emitting area in a method of driving an organic light-emitting display device according to the present invention;

FIG. 9 is a flowchart illustrating a method of driving an organic light-emitting display device according to another embodiment of the present invention;

FIG. 10 is a view illustrating an example where a light-emitting level is detected in an organic light-emitting display device according to the present invention; and FIG. 11 is a view illustrating another example where a light-emitting level is detected in an organic light-emitting display device according to the present invention.

MODE FOR THE INVENTION

Hereinafter, preferred embodiments of the present invention will be described in detail with reference to accompanying drawings.

FIG. 1 is a schematic block diagram of an organic light-emitting display device according to the present invention.

Referring to FIG. 1, the light-emitting display device includes a light-emitting unit 11, a light-emitting level setting unit 13, a look-up table (LUT) 15, and a light-emitting control unit 17.

Here, the light-emitting unit 11 includes a plurality of OLEDs to emit light over an entire area or a partial area under control of the light-emitting control unit 17. At this point, the light-emitting control unit 17 controls a light-emitting area and/or light-emitting degree of the light-emitting unit 11 according to a relevant light-emitting level with reference to data set on the look-up table 15.

Also, the light-emitting level setting unit 13 sets a light-emitting level depending on a light-emitting area of the light-emitting unit and/or a change in a light-emitting degree of the light-emitting unit 11. That is, the light-emitting level setting unit 13 extracts data from an input image frame to set a light-emitting level of the input frame. Data for a light-emitting degree of the light-emitting unit 11 that corresponds to each light-emitting area for each light-emitting level according to the light-emitting level set in this manner may be obtained from the look-up table 15.

After that, the light-emitting control unit 17 controls the light-emitting area and/or light-emitting degree of the light-emitting unit 11 with reference to the set data stored in the look-up table 15 when displaying an image contained in a next frame.

Here, the light-emitting control unit 17 drives the OLEDs of the light-emitting unit 11 using a value less than data of a light-emitting degree stored in the look-up table 15 according to a relevant light-emitting level.

The light-emitting level setting unit 13 may extract data from an entire image display region of an input frame to set a light-emitting level. Also, the light-emitting level setting unit 13 extracts data from a partial image display region of an input frame to set a light-emitting level. At this point, the light-emitting level setting unit 13 may classify and set the light-emitting level using power consumption of the light-emitting unit 11 when setting the light-emitting level.

On the other hand, data for the light-emitting degree stored in the look-up table 15 may contain information regarding a maximum light-emitting time and/or maximum number of light-emitting depending on the light-emitting area of the light-emitting unit 11. Here, the data for the light-emitting degree stored in the look-up table 15 is set such that a maximum light-emitting time and/or maximum number of light-emitting of the light-emitting unit 11 decreases as the light-emitting area of the light-emitting unit 11 increases for the same light-emitting level.

Also, the light-emitting control unit 17 controls an input current value input to the light-emitting unit 11 together with the light-emitting area and/or light-emitting degree of the light-emitting unit 11 depending on the light-emitting level when controlling the light-emitting unit 11 to drive the OLEDs.

Also, an example of a method of driving an organic light-emitting display device according to the present invention will be described with reference to FIG. 2, which is a flowchart illustrating a method of driving an organic light-emitting display device according to the present invention.

On the first place, according to the method, data is extracted from an input frame and then a light-emitting level is set according to a light-emitting area and a change in a light-emitting degree of the light-emitting unit having a plurality of OLEDs (operation 201).

Here, assuming that light-emitting levels are classified into 256 levels, for example, when the light-emitting levels are set, a level for a largest light-emitting area with consideration of a light-emitting degree may be expressed as 255, and a level for a smallest light-emitting area may be expressed as 0. The setting of the light-emitting level for each level will be described below.

At this point, the light-emitting area means an actual light-emitting area of the light-emitting unit having the plurality of OLEDs. Referring to FIG. 3, the light-emitting area 11*a*, 11*b*, and 11*c* may change into various sizes. FIG. 3 is a diagram explaining a change in a light-emitting area of an organic light-emitting display device according to the present invention.

Also, according to a method of driving an organic light-emitting display device, a light-emitting area and/or light-emitting degree of the light-emitting unit is controlled according to the set light-emitting level, so that an image is displayed (operation 203).

Data for the light-emitting degree proposed by the present invention may contain information regarding a maximum light-emitting time and/or maximum number of light-emitting depending on the light-emitting area of the light-emitting unit 11.

Here, referring to FIG. 4, the data for the light-emitting degree is set such that a maximum light-emitting time of the light-emitting unit 11 decreases as the light-emitting area of the light-emitting unit 11 increases for the same light-emitting level. FIG. 4 is a view explaining a light-emitting time of each organic light-emitting device during one frame for a light-emitting area of an organic light-emitting display device in a method of driving an organic light-emitting display device according to the present invention.

Referring to FIG. 5, the data for the light-emitting degree is set such that the number of light-emitting of the light-emitting unit 11 decreases as the light-emitting area of the light-emitting unit 11 increases for the same light-emitting level. FIG. 5 is a view explaining the number of light-emitting of each organic light-emitting device during one frame for a light-emitting area of an organic light-emitting display device in a method of driving an organic light-emitting display device according to the present invention.

The data for a light-emitting degree that corresponds to each light-emitting area for each light-emitting level is stored in the look-up table, and the look-up table is referred, so that a driving condition of the OLEDs of the light-emitting unit may be easily obtained.

FIG. 6 is a view illustrating an example where a light-emitting area and a light-emitting degree within the area of an organic light-emitting display device are defined in a method of driving an organic light-emitting display device according to the present invention.

Referring to FIG. 6, the light-emitting level may be defined as 128 levels using "White window pattern" Here, "100% white window pattern" corresponds to a level where all pixels contained in a screen are turned on with maximum brightness (a largest data input). Also, "20% white window pattern" corresponds to a level where a same pattern is displayed with an area portion of 20% in an entire screen. The "20% white window pattern" has been set to a level 0. At this point, a "white window pattern having an area less than 20% corresponds to a level 0, of course, and a pattern showing the same power consumption as that of the white window pattern having a relevant area in an aspect of power consumption regardless of an image pattern is also regarded as being the same light-emitting level. Power consumption of the light-emitting unit may be obtained through analysis of input data.

On the other hand, according to a related art method of driving an organic light-emitting display device, power consumption is generated as illustrated in FIG. 7. FIG. 7 is a view illustrating power consumption versus a light-emitting area ratio when an input current value of an organic light-emitting device is constant in a method of driving an organic light-emitting display device according to the present invention.

That is, assuming that patterns (here, "white window pattern") in which an image is displayed is the same and only a difference in a light-emitting area is present in the related art method of driving the organic light-emitting display device, power consumption increases in direct proportion to a light-emitting area as the light-emitting area increases as illustrated in FIG. 7 because a current value input to each OLED constituting the light-emitting unit has a constant maximum value and the number of pixels emitting light is in direct proportion to an area.

However, according to a method of driving an organic light-emitting display device of the present invention, power consumption illustrated in FIG. 8 is generated. FIG. 8 is a view illustrating power consumption when an input current value of an organic light-emitting device is controlled according to a light-emitting area in a method of driving an organic light-emitting display device according to the present invention.

According to the present invention, since a light-emitting area having a level less than a predetermined level (here, 20%) is defined as a level 0, power consumption for a pattern where an area with consideration of a light-emitting degree (intensity) is less than 20% increase in direct proportion to the light-emitting area as in the related art.

However, it is possible to drive such that an organic light-emitting display device has power consumption less than a predetermined value regardless of a light-emitting area on which an image is displayed as illustrated in FIG. 8 by controlling a light-emitting time or the number of light-emitting of each OLED for a pattern where the light-emitting area is more than 20%. Such constant power consumption can be realized by reducing the light-emitting time and/or the number of light-emitting of each OLED as the light-emitting area increases.

FIG. 9 is a flowchart illustrating a method of driving an organic light-emitting display device according to another embodiment of the present invention.

According to the method, data is extracted from an input frame, and a light-emitting level is set according to a light-emitting area and a change in a light-emitting degree of a light-emitting unit having a plurality of OLEDs (operation 901).

Also, according to the method, the light-emitting area and/or light-emitting degree of a light-emitting unit according to the set light-emitting level, and simultaneously, an input current value input to the light-emitting unit is controlled, so that an image is displayed (operation 903).

Data for the light-emitting degree proposed by the present invention may contain information regarding a maximum light-emitting time and/or maximum number of light-emitting depending on the light-emitting area of the light-emitting unit 11.

Here, referring to FIG. 4, the data for the light-emitting degree is set such that a maximum light-emitting time of the light-emitting unit 11 decreases as the light-emitting area of the light-emitting unit 11 increases for the same light-emitting level. Referring to FIG. 5, the data for the light-emitting degree is set such that the number of light-emitting of the light-emitting unit 11 decreases as the light-emitting area of the light-emitting unit 11 increases for the same light-emitting level.

Also, the input current value input to the light-emitting unit is set such that a maximum current value input to the light-emitting unit decreases as the light-emitting area of the light-emitting unit 11 increases for the same light-emitting level.

The data for the light-emitting degree that corresponds to each light-emitting area for each light-emitting level, and data for the input current are stored in the look-up table, and the look-up table is referred, so that a driving condition of the OLEDs of the light-emitting unit may be easily obtained.

At this point, the OLEDs of the light-emitting unit are driven using values less than the data for the light-emitting degree (light-emitting time and the number of light-emitting) and the data for the input current stored in the look-up table when the light-emitting unit is controlled according to the set light-emitting level and an image is displayed. It is possible to set an operation condition below predetermined power consumption using the above-described driving method.

On the other hand, referring to FIGS. 10 and 11, the present invention can analyze a pattern for determining a light-emitting level with consideration of a light-emitting area and a light-emitting degree over an entire region having arbitrary resolution. Also, the present invention can determine a light-emitting level through a small amount of calculations without a significant error using data extraction for a partial region (a kind of sampling), not an entire region. FIG. 10 is a view illustrating an example where a light-emitting level is detected in an organic light-emitting display device according to the present invention, and FIG. 11 is a view illustrating another example where a light-emitting level is detected in an organic light-emitting display device according to the present invention.

FIG. 11 illustrates a case where data of above ⅓ level compared to a case of FIG. 10 are sampled and detected. Tables 1 and 2 show that an error of less than about 1% is generated. Table 1 shows results extracted from FIG. 10, and Table 2 shows results extracted from FIG. 11.

TABLE 1

| | The number of pixels | Ratio |
|---|---|---|
| Blue | 65 | 0.0903 |
| White | 150 | 0.2083 |
| total | 720 | 1.0000 |

TABLE 2

| | The number of pixels | Ratio |
|---|---|---|
| Blue | 21 | 0.0875 |
| White | 48 | 0.2000 |
| total | 240 | 1.0000 |

An organic light-emitting display device having the above-described structure can be used for a mobile communication terminal and remarkably reduce power consumption. Also, the organic light-emitting display device can be used for image display devices such as computer monitors, televisions, and electronic display boards, and remarkably reduce power consumption.

The mobile communication terminal includes the above-described organic light-emitting display device, a communication element performing communication with the outside, and a controller controlling the communication element and displaying by the organic light-emitting display device.

The image display devices include the above-described organic light-emitting display device and a controller transmitting video signals to the organic light-emitting display device.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

Industrial Applicability

According to an organic light-emitting display device and a driving method thereof, there is an advantage of managing power consumption below a set value regardless of a light emitting area and a light emitting degree of a light-emitting unit having organic light-emitting devices.

The invention claimed is:

1. An organic light-emitting display device comprising:

a light-emitting unit having a plurality of OLEDs (organic light-emitting diodes) to emit light;

a light-emitting level setting unit, wherein the light-emitting level setting unit sets a light-emitting level depending on a light-emitting area and/or a change in a light-emitting degree of the light-emitting unit;

a look-up table in which data for the light-emitting degree of the light-emitting unit that corresponds to each light-emitting area for each light-emitting level is set and stored; and a light-emitting control unit capable of controlling the light-emitting area and the light-emitting degree of the light-emitting unit depending on a light-emitting level with reference to the data set on the look-up table when displaying an image contained in a next frame, wherein a power consumption of the light-emitting unit at a light-emitting area ratio less than 20% increases in proportion to the light-emitting area, wherein a power consumption of the light emitting unit at a light-emitting area ratio more than 20% remains at a constant value less than a predetermined value regardless of the light-emitting area, wherein the data for the light-emitting degree stored in the look-up table contains a maximum light-emitting time and/or maximum amount of light-emitting according to them light-emitting area of the light-emitting unit, and wherein the data for the light-emitting degree stored in the look-up table is set such that the maximum light-emitting time and/or maximum amount of light-emitting of the light-emitting unit decreases as the light-emitting area of the light-emitting unit increases for the same light-emitting level.

2. The organic light-emitting display device according to claim 1, wherein the light-emitting control unit drives the OLEDs of the light-emitting unit using a emitting degree value less than the light-emitting degree value stored in the look-up table for a selected light-emitting level.

3. The organic light-emitting display device according to claim 1, wherein the light-emitting level setting unit extracts data from an entire image display region of an input frame to set the light-emitting level.

4. The organic light-emitting display device according to claim 1, wherein the light-emitting level setting unit extracts data from a partial image display region of an input frame to set the light-emitting level.

5. The organic light-emitting display device according to claim 1, wherein the light-emitting level setting unit classifies and sets light-emitting levels according to power consumption of the light-emitting unit when setting the light-emitting levels.

6. The organic light-emitting display device according to claim 1, wherein the light-emitting control unit controls an input current value to the light-emitting unit together with the light-emitting area and/or light-emitting degree of the light-emitting unit according to the light-emitting level when controlling the light-emitting unit.

7. A method of driving an organic light-emitting display device, wherein the method comprises:

extracting data from an input frame and setting a light-emitting level according to a light-emitting area and a change in a light-emitting degree of a light-emitting unit having a plurality of OLEDs; and controlling the light-emitting area and/or light-emitting degree of the light-emitting unit according to the set light-emitting level and displaying an image when displaying an image contained in a next frame, wherein a power consumption of the light-emitting unit at a light-emitting area ratio less than 20% increases in proportion to the light-emitting area, wherein a power consumption of the light emitting unit at a light-emitting area ratio more than 20% remains at a constant value less than a predetermined value regardless of the light-emitting area, wherein the controlling of the light-emitting area and/or light-emitting degree of the light-emitting unit according to the set light-emitting level to display the image comprises driving the OLEDs of the light-emitting unit with reference to a look-up table in which data for the light-emitting degree of the light-emitting unit that corresponds to each light-emitting area for each light-emitting level is set and stored, wherein the data for the light-emitting degree stored in the look-up table contains a maximum light-emitting time and/or maximum amount of light-emitting depending on the light-emitting area of the light-emitting unit, and wherein the data for the light-emitting degree stored in the look-up table is set such that the maximum light-emitting time and/or maximum amount of light-emitting of the light-emitting unit decreases as the light-emitting area of the light-emitting unit increases for the same light-emitting level.

8. The method according to claim 7, wherein the setting of the light-emitting level comprises extracting data from an entire image display region of an input frame to set the light-emitting level.

9. The method according to claim 7, wherein the setting of the light-emitting level comprises extracting data from a partial image display region of an input frame to set the light-emitting level.

10. The method according to claim 7, wherein the controlling of the light-emitting area and/or light-emitting degree of the light-emitting unit according to the set light-emitting level to display the image comprises driving the OLEDs of the light-emitting unit using a light-emitting degree value less than the light-emitting degree value stored in the look-up table for a selected light-emitting level.

11. The method according to claim 7, wherein the setting of the light-emitting level comprises classifying and setting light-emitting levels according to power consumption of the light-emitting unit.

12. A method of driving an organic light-emitting display device, wherein the method comprises:

extracting data from an input frame and setting a light-emitting level according to a light-emitting area and a change in a light-emitting degree of a light-emitting unit having a plurality of OLEDs; and controlling the light-emitting area and/or light-emitting degree of the light-emitting unit according to the set light-emitting level, and controlling an input current value to the light-emitting unit to display an image when displaying an image contained in a next frame, wherein a power consumption of the light-emitting unit at a light-emitting area ratio less than 20% increases in proportion to the light-emitting area, wherein a power consumption of the light emitting unit at a light-emitting area ratio more than 20% remains at a constant value less than a predetermined value regardless of the light-emitting area, wherein the controlling of the light-emitting area and/or light-emitting degree of the light-emitting unit according to the set light-emitting level to display the image comprises driving the OLEDs of the light-emitting unit with reference to a look-up table in which data for the light-emitting degree and an input current of the light-emitting unit that corresponds to each light-emitting area for each light-emitting level is set and stored, wherein the data for the light-emitting degree stored in the look-up table contains a maximum light-emitting time and/or maximum amount of light-emitting according to the light-emitting area of the light-emitting unit, and wherein the data for the light-emitting degree stored in the look-up table is set such that the maximum light-emitting time and/or maximum amount of light-emitting of the light-emitting unit decreases as the light-emitting area of the light-emitting unit increases for the same light-emitting level.

13. The method according to claim 12, wherein the setting of the light-emitting level comprises extracting data from an entire image display region of an input frame to set the light-emitting level.

14. The method according to claim 12, wherein the setting of the light-emitting level comprises extracting data from a partial image display region of an input frame to set the light-emitting level.

15. The method according to claim 12, wherein the data for the input current stored in the look-up table is set such that a maximum input current to the light-emitting unit decreases as the light-emitting area of the light-emitting unit increases for the same light-emitting level.

16. The method according to claim 12, wherein the controlling of the light-emitting area and/or light-emitting degree of the light-emitting unit according to the set light-emitting level to display the image comprises driving the OLEDs of the light-emitting unit using a value for the light-emitting degree and a value for the input current that is less than the light-emitting degree and input current values stored in the look-up table for a selected light-emitting level.

17. The method according to claim 12, wherein the setting of the light-emitting level comprises classifying and setting light-emitting levels according to power consumption of the light-emitting unit when setting the light-emitting levels.

18. A mobile communication terminal comprising:

an organic light-emitting display device including a light-emitting unit having a plurality of OLEDs to emit light, a light-emitting level setting unit, wherein the light-emitting level setting unit sets a light-emitting level according to a light-emitting area and/or a change in a light-emitting degree of the light-emitting unit, a look-up table in which data for the light-emitting degree of the light-emitting unit that corresponds to each light-emitting area for each light-emitting level is set and stored according to the light-emitting level set by the light-emitting level setting unit, and a light-emitting control unit capable of controlling the light-emitting area and the light-emitting degree of the light-emitting unit depending on a light-emitting level with reference to the data set on the look-up table when displaying an image contained in a next frame;

a communication element to perform communication with the outside; and a controller to control the communication element and the organic light-emitting display device, wherein a power consumption of the light-emitting unit at a light-emitting area ratio less than 20% increases in proportion to the light-emitting area, wherein a power consumption of the light emitting unit at a light-emitting area ratio more than 20% remains at a constant value less than a predetermined value regardless of the light-emitting area, wherein the data for the light-emitting degree stored in the look-up table contains a maximum light-emitting time and/or maximum amount of light-emitting according to the light-emitting area of the light-emitting unit, and wherein the data for the light-emitting degree stored in the look-up table is set such that the maximum light-emitting time and/or maximum amount of light-emitting of the light-emitting unit decreases as the light-emitting area of the light-emitting unit increases for the same light-emitting level.

19. A mobile communication terminal comprising:

an organic light-emitting display device including:

a light-emitting unit having a plurality of OLEDs to emit light, a light-emitting level setting unit, wherein the light-emitting level setting unit sets a light-emitting level depending on a light-emitting area and/or a change in a light-emitting degree of the light-emitting unit, a look-up table in which data for the light-emitting degree of the light-emitting unit that corresponds to each light-emitting area for each light-emitting level is set and stored according to the light-emitting level set by the light-emitting level setting unit, and a light-emitting control unit capable of controlling the light-emitting area and the light-emitting degree of the light-emitting unit according to a light-emitting level with reference to the data set on the look-up table when displaying an image contained in a next frame; and a controller capable of transmitting image signals to the organic light-emitting display device, wherein a power consumption of the light-emitting unit at a light-emitting area ratio less than 20% increases in proportion to the light-emitting area, wherein a power consumption of the light emitting unit at a light-emitting area ratio more than 20% remains at a constant value less than a predetermined value regardless of the light-emitting area, wherein the data for the light-emitting degree stored in the look-up table contains a maximum light-emitting time and/or maximum amount of light-emitting according to the light-emitting area of the light-emitting unit, and wherein the data for the light-emitting degree stored in the look-up table is set such that the maximum light-emitting time and/or maximum amount of light-emitting of the light-emitting unit decreases as the light-emitting area of the light-emitting unit increases for the same light-emitting level.

* * * * *